US008816920B2

(12) United States Patent
Abe et al.

(10) Patent No.: US 8,816,920 B2
(45) Date of Patent: Aug. 26, 2014

(54) MOBILE ELECTRONIC DEVICE

(75) Inventors: Yasuhiro Abe, Yokohama (JP); Hiroshi Sakai, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 503 days.

(21) Appl. No.: 13/094,405

(22) Filed: Apr. 26, 2011

(65) Prior Publication Data

US 2011/0260940 A1 Oct. 27, 2011

(30) Foreign Application Priority Data

Apr. 26, 2010 (JP) ..... 2010-100978

(51) Int. Cl.
*H01Q 9/04* (2006.01)
*H01Q 7/00* (2006.01)
*H01Q 5/00* (2006.01)

(52) U.S. Cl.
CPC ..... *H01Q 7/00* (2013.01); *H01Q 7/005* (2013.01); *H01Q 5/0093* (2013.01); *H01Q 5/0062* (2013.01)
USPC ..... 343/745; 455/571; 455/550.1; 455/77; 455/73; 455/78

(58) Field of Classification Search
USPC ..... 343/45, 745; 455/571, 550.1, 77, 73, 78
See application file for complete search history.

(56) References Cited

U.S. PATENT DOCUMENTS

2005/0062667 A1* 3/2005 Shirosaka et al. ..... 343/794
2005/0128155 A1* 6/2005 Fukuda ..... 343/745
2005/0170800 A1* 8/2005 Taromaru et al. ..... 455/191.3
2007/0146213 A1* 6/2007 Soekawa et al. ..... 343/702
2007/0268191 A1* 11/2007 Ishizuka et al. ..... 343/702
2008/0081574 A1* 4/2008 Shih et al. ..... 455/187.1
2009/0040120 A1* 2/2009 Tsubaki et al. ..... 343/702
2009/0115674 A1* 5/2009 Fujieda et al. ..... 343/745
2009/0273531 A1* 11/2009 Ishizuka et al. ..... 343/750
2010/0093390 A1* 4/2010 Waku et al. ..... 455/552.1
2010/0130140 A1 5/2010 Waku et al.
2012/0062434 A1* 3/2012 Kim et al. ..... 343/749
2013/0002494 A1* 1/2013 Ayala et al. ..... 343/702

FOREIGN PATENT DOCUMENTS

JP 2004-227046 8/2004
WO WO 2008/041652 4/2008
WO 2008123456 A1 10/2008

OTHER PUBLICATIONS

Non-Final Rejection dated Jan. 28, 2014 issued by Japanese Patent Office for Japanese Patent Application No. 2010-100978.

* cited by examiner

*Primary Examiner* — Allyson Trail

(57) ABSTRACT

A mobile electronic device comprises an RFID antenna section that sends and receives signals on a first useful frequency band, a main antenna section that sends and receives signals on a second useful frequency band, which is a higher frequency band than the first useful frequency band, an adjustment section that adjusts a resonance frequency of the RFID antenna section, and a control section that identifies a reactance value of the RFID antenna section based on the receiving sensitivity with respect to signals on the first useful frequency band and adjusts the resonance frequency of the RFID antenna section based on the identified reactance value by an adjustment section such that a high-order resonance frequency of the RFID antenna section is spaced apart from the second useful frequency band.

8 Claims, 12 Drawing Sheets

Fig.8

| n Degree | f [MHz] |
|---|---|
| 60 | 812.89079 |
| 61 | 826.43897 |
| 62 | 839.98715 |
| 63 | 853.53533 |
| 64 | 867.08351 |
| 65 | 880.63169 |
| 66 | 894.17987 |
| 67 | 907.72805 |
| 68 | 921.27623 |
| 69 | 934.82441 |

Fig.9

| n Degree | MHz |
|---|---|
| 5 | 375.13212 |
| 6 | 450.15854 |
| 7 | 525.18496 |
| 8 | 600.21138 |
| 9 | 675.23781 |
| 10 | 750.26423 |
| 11 | 825.29065 |
| 12 | 900.31708 |
| 13 | 975.3435 |
| 14 | 1050.3699 |

Fig.10

| n Degree | MHz |
|---|---|
| 5 | 459.44113 |
| 6 | 551.32936 |
| 7 | 643.21759 |
| 8 | 735.10581 |
| 9 | 826.99404 |
| 10 | 918.88227 |
| 11 | 1010.7705 |
| 12 | 1102.6587 |
| 13 | 1194.5469 |
| 14 | 1286.4352 |

MOBILE ELECTRONIC DEVICE

CROSS-REFERENCE TO RELATED APPLICATION

The present application claims priority under 35 U.S.C. §119 to Japanese Patent Application No. 2010-100978, filed on Apr. 26, 2010, entitled "MOBILE ELECTRONIC DEVICE". The content of which is incorporated by reference herein in its entirety.

FIELD

The present invention relates to a mobile electronic device that performs communication with other terminals.

BACKGROUND

A technology configured such that a first antenna section and a second antenna section are embedded and the high-order secondary resonance point of a first useful frequency band that is a useful frequency band of the first antenna section does not overlap with a second useful frequency band that is a useful frequency band of the second antenna section is suggested. The technology reduces the affection to the second antenna section caused by the high-order secondary resonance point of the first antenna section.

A novel configuration in which the high-order secondary resonance point of the first antenna section does not overlap with the useful frequency band of the second antenna section is desired.

SUMMARY

According to one aspect of the present invention, a mobile electronic device comprises a housing, a first antenna section, a second antenna section, an adjustment section, and a control section.

The first antenna section is arranged in the housing, and sends and receives a signal on a first useful frequency band. The second antenna section is arranged in the housing and sends and receives a signal on a second useful frequency band that is a higher frequency band than the first useful frequency band. The adjustment section adjusts the resonance frequency of the first antenna section. The control section identifies a reactance value of the first antenna section based on the receiving sensitivity with respect to signals on the first useful frequency band, and adjusts the resonance frequency of the first antenna section based on the identified reactance value by the adjustment section such that a high-order resonance frequency of the first antenna section is spaced apart from the second useful frequency band.

BRIEF DESCRIPTION OF THE DRAWINGS

Embodiments of the present disclosure are hereinafter described in conjunction with the following figures, wherein like numerals denote like elements. The figures are provided for illustration and depict exemplary embodiments of the present disclosure. The figures are provided to facilitate understanding of the present disclosure without limiting the breadth, scope, scale, or applicability of the present disclosure. The drawings are not necessarily made to scale.

FIG. 8 is a figure showing a higher resonance frequency of an RFID antenna section.

FIG. 9 is a figure showing a higher resonance frequency of an RFID antenna section.

FIG. 10 is a figure showing a higher resonance frequency of an RFID antenna section.

DETAILED DESCRIPTION

The following description is presented to enable a person of ordinary skill in the art to make and use the embodiments of the disclosure. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. Furthermore, there is no intention to be bound by any expressed or implied theory presented in the preceding field, background, summary or the following detailed description. The present disclosure should be accorded scope consistent with the claims, and not limited to the examples described and shown herein.

Embodiments of the disclosure are described herein in the context of one practical non-limiting application, namely, an information device. Embodiments of the disclosure, however, are not limited to such mobile information devices, and the techniques described herein may also be utilized in other applications. For example, embodiments may be applicable to mobile phones, digital books, digital cameras, electronic game machines, digital music players, personal digital assistance (PDA), personal handy phone system (PHS), lap top computers, and the like.

As would be apparent to one of ordinary skill in the art after reading this description, these are merely examples and the embodiments of the disclosure are not limited to operating in accordance with these examples. Other embodiments may be utilized and structural changes may be made without departing from the scope of the exemplary embodiments of the present disclosure.

Figure 1:
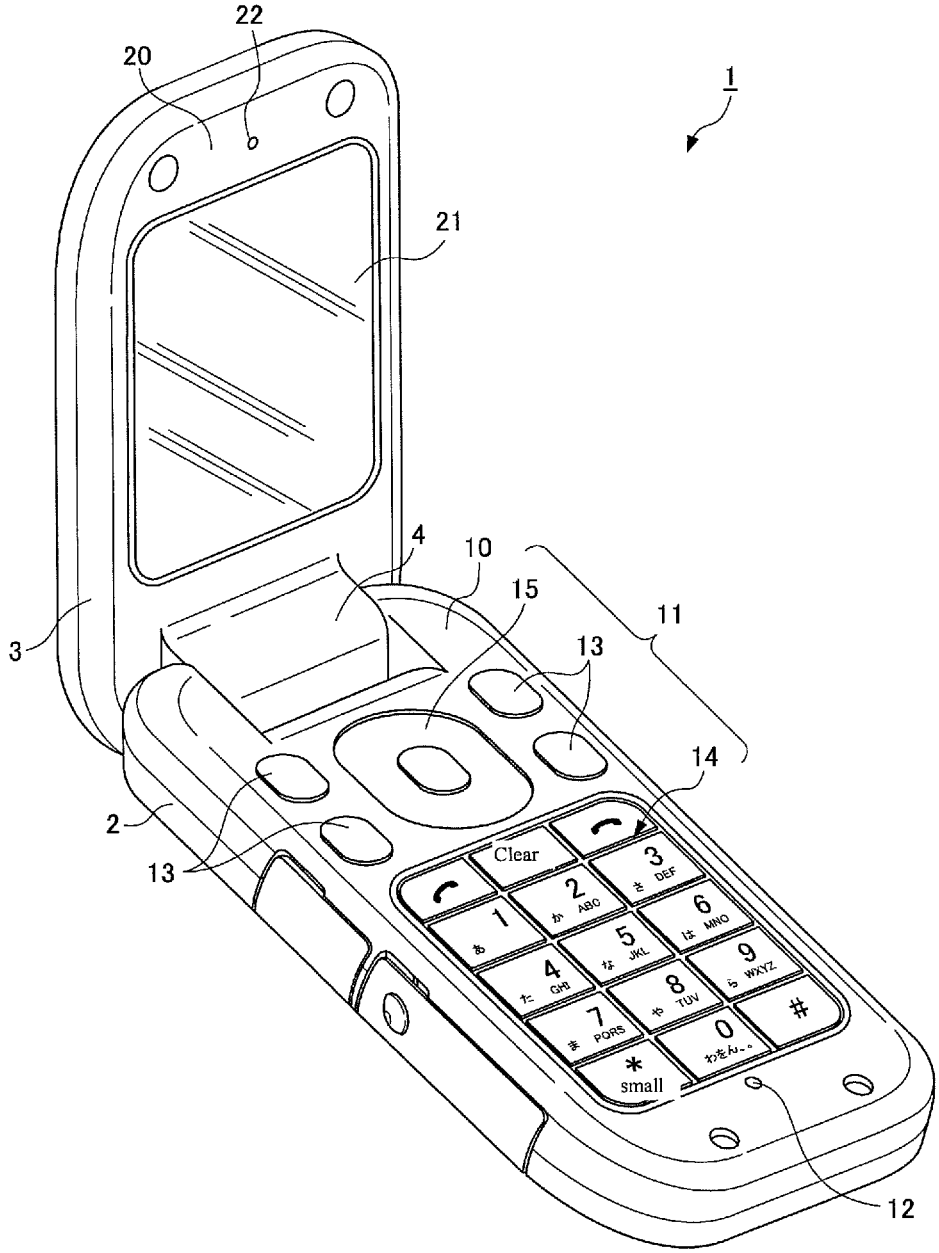
FIG. 1 is an external perspective view of a mobile phone device.

Embodiments of the present invention will now be described. FIG. 1 shows an external perspective view of a mobile phone device 1 that is one example of the mobile terminal according to the present invention. FIG. 1 shows one configuration of a mobile phone device, namely the so-called folded form; however the configuration of mobile phone device of the present invention is not particularly limited to this. For example, it may be a slide-open style, in which one of the housings slides in one direction from a state in which both housings are overlapping each other, a twist-style (twist type), in which one housing rotates on an axis line along the direction of the overlap, or a style that does not have a connecting section (straight type), in which the operating section and the display section are disposed on one housing.

As shown in FIG. 1, a mobile phone device 1 comprises an operation-section-side housing section 2 and a display-section-side housing section 3. The operation-section-side housing section 2 comprises an operation button group 11 and a sound input section 12, which inputs sounds emitted by a user of the mobile phone device 1, on a surface section 10. The operation button group 11 comprises a function settings operation button 13 for operating various functions such as various settings, an address book function and mail function, etc., an input operation button 14 for inputting digits of a phone number and letters, etc., such as mails, etc., and a decision operation button 15 for performing decisions regarding various operations and scrolling, etc.

Moreover, display-section-side housing section 3 comprises a display 21 for displaying various types of information and a sound output section 22 that outputs sounds from a call partner on a surface section 20.

Moreover, the abovementioned operation button group 11, sound input section 12, display 21 and sound output section 22 constitute a part of processing section 71, which will be mentioned later.

Moreover, the upper end of an operation-section-side housing section 2 and the lower end of a display-section-side housing section 3 are connected through a hinge mechanism 4. Mobile phone device 1 can shift relatively between a state in which both the operation-section-side housing section 2 and the display-section-side housing section 3 are open with respect to each other (open state) and a state in which the operation-section-side housing section 2 and the display-section-side housing section 3 are folded, by relatively rotating the operation-section-side housing section 2 and the display-section-side housing section 3 connected through the hinge mechanism 4.

Figure 2:
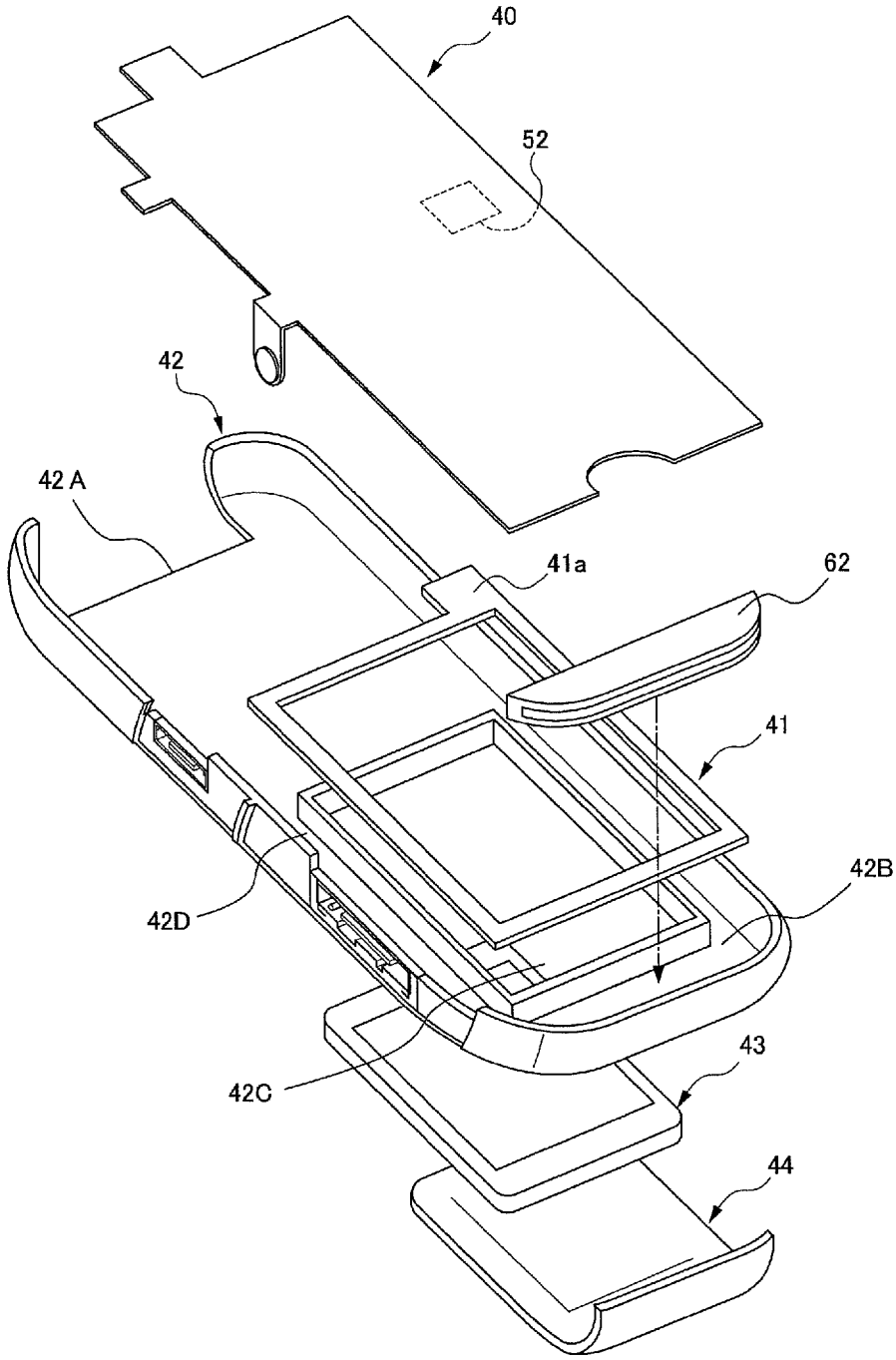
FIG. 2 is an exploded perspective view of part of an operation-section-side housing section.

Moreover, FIG. 2 shows an exploded perspective view of part of the operation-section-side housing section 2. As shown in FIG. 2, the operation-section-side housing section 2 comprises a circuit board 40, An RFID antenna section 41, a rear case section 42, a battery 43 and a battery cover 44.

A control section 72 that performs prescribed arithmetic processing and an RFID chip 52, which will be described later, is mounted on the circuit board 40. When the operation button group 11 is operated by a user, the control section 72 is fed the prescribed signal and implements a prescribed function.

The RFID antenna section 41 performs electromagnetic communication with external equipment using a first useful frequency band (e.g. a frequency band taking 13.56 MHz as a center frequency) by operating with the RFID chip 52 mounted on the circuit board 40 and an adjustment section 53 which will be described later. The RFID chip 52 performs a prescribed process for information sent and received through the RFID antenna section 41. Furthermore, the processing section comprising the RFID antenna section 41, the RFID chip 52 and the adjustment section 53, is hereinafter referred to as RFID processing section 51.

Moreover, in the embodiments of the present invention, the RFID chip 52 is mounted in a position opposing the connection terminal 41*a* on the circuit board 40, so as to connect the connection terminal 41*a* of the RFID antenna section 41 housed in the rear case section 42 in the most direct way when the rear case section 42 and the circuit board 40 are combined, but is not particularly limited to this configuration.

The rear case section 42 comprises a hinge mechanism fixed section 42A that fixes hinge mechanism 4, a main antenna housing section 42B housing a main antenna section 62 that performs communication by a second useful frequency band (e.g. a frequency band taking 800 MHz as a center frequency), which is a higher frequency band than the first useful frequency band, a battery storage section 42C storing the battery 43, and an RFID antenna fixed section 42D that fixes the RFID antenna section 41.

Figure 3:
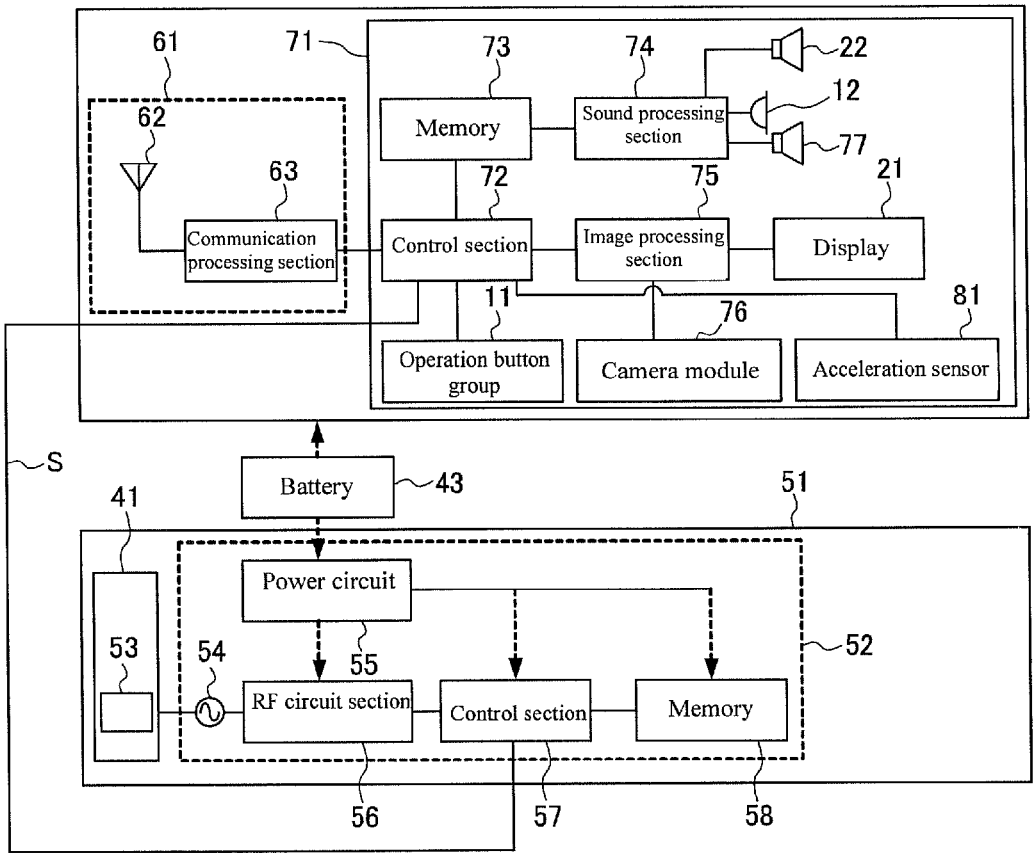
FIG. 3 is a functional block diagram of a mobile phone device.

Moreover, FIG. 3 is a functional block diagram showing the functions of a mobile phone device 1. As shown in FIG. 3, the mobile phone device 1 comprises an RFID processing section 51, a communication section 61 and a processing section 71.

As described above, the RFID processing section 51 comprises an RFID antenna section 41 that performs electromagnetic communication with external equipment using the first useful frequency band (e.g. 13.56 MHz), an RFID chip 52 and an adjustment section 53.

For example, the RFID antenna section 41 comprises an antenna element made of copper lines having a prescribed diameter (e.g. about 0.1 mm), etc., forming a coil wrapped in a multiple spiral form to form a loop of a prescribed size on a sheet made from PET (polyethylene terephthalate) material and, under prescribed conditions, the RFID antenna section 41 sends and receives signals on a first useful frequency band to and from the external equipment. Herein, "under prescribed conditions" means, for example, being tuned to send and receive a prescribed signal by the adjustment section 53.

The RFID chip 52 comprises a power feeding section 54, a power circuit section 55, a RF circuit section 56, a control section 57 and memory 58.

The power circuit section 55 is, for example, a DC-DC converter and a circuit section generating a prescribed power-supply voltage. The RF circuit section 56 performs signal processing such as modulation processing or demodulation processing, etc., on a signal communicated by the RFID antenna section 41. The control section 57 performs prescribed arithmetic processing. Memory 58 stores prescribed data.

Herein, the operation of RFID processing section 51 is described.

The RFID antenna section 41 receives a signal sent from a relevant external equipment (modulated by a carrier frequency band, which is a first useful frequency (e.g. 13.56 MHz)), when approaching to within a predetermined distance from a reader/writer equipment (external equipment) that is externally located. The adjustment section 53 varies reactance appropriately, and performs prescribed adjustment (tuning) such that RF circuit section 56 is fed signals sent from the external equipment through RFID antenna section 41.

The power circuit section 55 generates a prescribed voltage based on a voltage fed from battery 43 and feeds the prescribed voltage to the RF circuit section 56, the control section 57 and the memory 58. Moreover, the RF circuit section 56, the control section 57 and the memory 58 are moved from the stopped-state to the startup-state by being fed the prescribed voltage from the power circuit section 55.

The RF circuit section 56 performs signal processing such as demodulation, etc., on signals received from the RFID antenna section 41 and feeds processed signals to the control section 57.

The control section 57 writes data to the memory 58 or reads data from memory 58 based on a signal fed from the RF circuit section 56. When reading data from the memory 58, the control section 57 feeds the relevant data to the RF circuit section 56. The RF circuit section 56 performs signal processing such as a modulation, etc., on data read from the memory 58, overlaps the modulated signal with a prescribed carrier wave (e.g. a carrier wave taking 13.56 MHz as a center frequency) and send it to the external equipment through the RFID antenna section 41.

Moreover, the RFID processing section 51, is described as an active type (Active) in which the activation is based on the voltage fed from battery 43, but is not limited to this; it may be a type in which an electromotive force is generated by electromagnetic inductive action using electromagnetic radiation radiated from an external equipment, that is, a passive type (Passive) induction field method (electromagnetic induction method), a passive type mutual induction method (electromagnetic coupling method) or a radiation electromagnetic field method (radio wave method), etc. Moreover, the access method of the RFID processing section 51, is described as the read/write type, but is not limited to this, and may be a read only type or a write once type, etc.

Moreover, as shown in FIG. 3, the communication section 61 comprises a main antenna section 62 and a communication processing section 63. The main antenna section 62 is an antenna section that performs communication with a base station on a second useful frequency band which is a higher frequency band than the first useful frequency band. The communication processing section 63 performs modulation processing on signals received from the main antenna section 62 or demodulation processing on signals to be sent to the exterior through the antenna section 62. Moreover, communication section 61 is fed with power from the battery 43.

The main antenna section 62 performs communication with the base station on the second useful frequency band (e.g. a frequency band taking 800 MHz as a center frequency) by operating together with the communication processing section 63. In the embodiments of the present invention, although the second useful frequency band is set as a frequency band taking 800 MHz as the center frequency, another frequency band may be used. Moreover, the main antenna section 62 may configured to be of a type that can correspond to a third useful frequency band (e.g. a frequency band taking 2 GHz as a center frequency) as well as the second useful frequency band, that is, a dual band corresponding type, or may further be a configuration that can support four or more useful frequency bands.

The communication processing section 63 demodulates a signal received from the antenna section 62 and feeds the processed signal to a processing section 71. Moreover, the communication processing section 63 modulates a signal fed from the processing section 71, overlaps the processed signal with a prescribed carrier wave (e.g. a carrier wave taking 800 MHz as a center frequency) and sends it to the base station through the main antenna section 62.

As shown in FIG. 3, the processing section 71 comprises an operation button group 11, a sound input section 12, a display 21, a sound output section 22, a control section 72 that performs prescribed arithmetic processing, a memory 73 that stores prescribed data, a sound processing section 74 that performs a sound processing, an image processing section 75 that performs prescribed image processing, a camera module 76 that images objects, a speaker 77 that outputs ringtones, and a acceleration sensor that measures the acceleration of the mobile phone device 1 etc. Moreover, the processing section 71 is fed with power from the battery 43. Furthermore, in the mobile phone device 1, as shown in FIG. 3, the control section 57 and the control section 72 are connected by a single line S. Therefore, information processed by the RFID processing section 51 is fed to image processing section 75 through the signal line S and the control section 72. Moreover, information processed by the image processing section 75 is fed to the display 21 and displayed.

As shown in FIG. 2, the RFID antenna section 41 and the main antenna section 62 are aligned adjacent to one another (e.g. several mm). Thus, when the two antennas are aligned adjacent to one another, problems are caused by the interference.

Specifically, the RFID antenna section 41 periodically has low-order and high-order secondary resonance points as well as a useful frequency band (13.56 MHz). Specially, when a high-order secondary resonance point (hereinafter called a high-order resonance point) overlaps with the useful frequency band (800 MHz) of the main antenna section 62, the gain of the main antenna section 62 degrades.

The mobile phone device 1 according to the present invention has functions that reduce the interference to the main antenna section 62 by a high-order resonance point of an RFID antenna section 41, and decrease gain degradation of the antenna section 62.

Herein, the operation of the control section 57 for realizing the above mentioned function is described in detail. As mentioned above, the mobile phone device 1 comprises the RFID antenna section 41 (the first antenna section), the main antenna section 62 (the second antenna section), the adjustment section 53 and the control section 57.

The RFID antenna section 41 is arranged in the operation-section-side housing section 2 and sends and receives signals on the first useful frequency band (e.g. 13.56 MHz). Similarly, the main antenna section 62 is aligned on the operation-section-side housing section 2 and sends and receives signals on the second useful frequency band (e.g. 800 MHz), which is a higher frequency band than the first useful frequency band. The adjustment section 53 adjusts the resonance frequency of the RFID antenna section 41.

The control section 57 identifies the RFID reactance value antenna section 41 based on the receiving sensitivity with respect to signals on the first useful frequency band, together with adjusting the resonance frequency of the RFID antenna section 41 by the adjustment section 53 such that the high-order resonance frequency of the RFID antenna section 41 is spaced apart from the second useful frequency band based on the identified reactance value. The operation by the control section 57 may be performed by the control section 72, which is connected with the signal line S.

Further details will be described later, but the control section 57 refers to a prescribed table and adjusts the resonance frequency of the RFID antenna section 41 by the adjustment section 53 based on the identified reactance value (L value) such that the high-order resonance frequency of the RFID antenna section 41 is spaced apart from the second useful frequency band.

Because it is configured in this way, the mobile phone device 1 ensures that a high-order secondary resonance point of the useful frequency band (a first useful frequency band) of the RFID antenna section 41 does not overlap with a useful frequency band (a second useful frequency band) of the main antenna section 62 and even if multiple antennas having different frequency ranges are aligned adjacent to one another, the gain degradation of the antennas is decreased, so effective use of the space within the housing is made while maintaining communication quality.

Moreover, where the receiving sensitivity falls below a predetermined value when a signal of the second useful frequency band is received by the main antenna section 62, a configuration in which the control section 57 adjusts the resonance frequency of the RFID antenna section 41 by the adjustment section 53 such that high-order resonance frequency of the RFID antenna section 41 is spaced apart from the second useful frequency band is preferred.

Specifically, as the timing for adjusting the resonance frequency of the RFID antenna section 41, the control section 57 estimates that a high-order resonance frequency of the RFID antenna section 41 is affected and adjusts the resonance frequency of the RFID antenna section 41 where the receiving sensitivity falls below a predetermined value when verbal communication is performed using the main antenna section 62.

Because it is configured in this way, the mobile phone device 1 adjusts the resonance frequency of the RFID antenna section 41 by the adjustment section 53 under conditions in which the receiving sensitivity of the main antenna section 62 falls below a predetermined value, and the gain degradation of the main antenna may decrease while reducing the burden of processing caused by unneeded adjustments.

<Configuration of the RFID Antenna Section 41>

Figure 4:
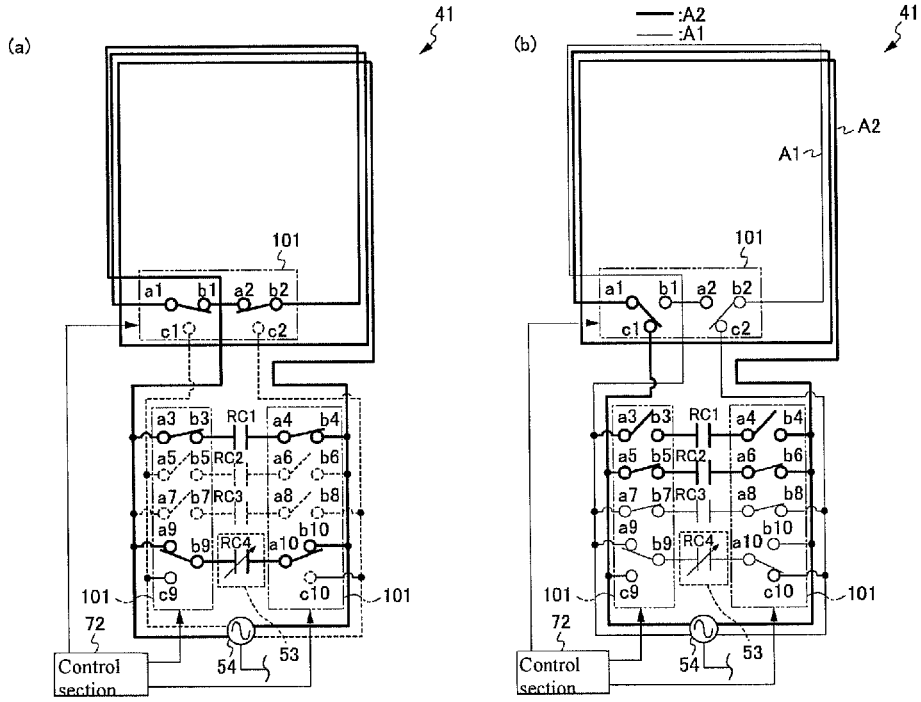
FIG. 4 is a figure provided to describe the state in which an antenna line of an antenna element section is branched (divided).

Herein, the RFID antenna section 41 and a detailed configuration of the periphery are described. As shown in FIG. 4, the RFID antenna section 41 has a separating section 101 that separates an antenna line A curled in a loop state according to the control of the control section 57 with a prescribed number of rotations.

For the RFID antenna section 41, the antenna line A curled in a loop state is connected to resonance capacitors RC1, RC2 and RC3 and a circuit for adjusting the resonance frequency, RC4. Furthermore, in the embodiments of the present invention, the capacitors for the resonance are capacitors having prescribed capacities, RC1, RC2 and RC3, and the circuit for adjusting the resonance frequency, RC4, is a variable capacitor that can adjust the resonance frequency, but they are not limited to this. Moreover, the circuit for adjusting the resonance frequency, RC 4 realizes a function corresponding to the adjustment section 53.

Herein, where the antenna line A is used with 3 turns, the control section 57 makes the antenna line A switch to 3 turns by performing a switching control such that an end terminal a1 and an end terminal b1, and an end terminal a2 and an end terminal b2 of the separating section 101 are in contact. Moreover, the control section 57 switches to contact an end terminal a3 with an end terminal b3 and an end terminal a4 with an end terminal b4 of the separating section of 101 so that the capacitors for the resonance, RC1 and the antenna line A are in contact and switches to contact an end terminals a9 with an end terminal b9 and an end terminals a10 with an end terminal b10 of the separating section of 101 so that the circuit for adjusting the resonance frequency, RC4 and the antenna line A are in contact (refer to FIG. 4(*a*))

Furthermore, an end terminal a5 and b5, an end terminal a6 and an end terminal b6, an end terminal a7 and an end terminal b7, and an end terminals a8 and an end terminal b8 of the separating section 101 are set so as to be not in contact, and so the capacitors for the resonance, RC2 or RC3, are not connected to the antenna line A.

Where the antenna line A is used with 1 turn and 2 turns, the control section 57 makes the antenna line A switch to 1 turn (A1) and 2 turn (A2) by performing switching control such that the end terminal a1 and the end terminal c1, and the end terminals b2 and the end terminal c2 of the separating section 101 are in contact. Moreover, the control section 57 switches to contact the end terminals a5 with the end terminal b5 and the end terminals a6 with the end terminal b6 of the separating section of 101 so that the resonance capacitor RC2 is connected to the antenna line A, and switches to contact the end terminals a7 with the end terminal b7 and the end terminals a8 with the end terminal b8 of the separating section of 101 so that the capacitors for the resonance frequency, RC3, is connected to the antenna line A (refer to FIG. 4(*b*)).

Moreover, where the antenna line A is used with 1 turn, the control section 57 switches to contact the end terminals a9 with the end terminal b9 and the end terminals a10 with the end terminal c10 of the separating section 101 so that the circuit for adjusting the resonance frequency, RC4, is connected to the antenna line A (A1) (refer to FIG. 4(*b*)).

Moreover, where the antenna line A is used with 2 turns, the control section 57 switches to contact the end terminals c9 with the end terminal b9 and the end terminals a10 with the end terminal b10 of the separating section 101 so that the circuit for adjusting the resonance frequency, RC4, is connected to the antenna line A (A2).

Furthermore, the end terminals a3 and the end terminal b3, and the end terminals a4 and the end terminal b4 of the separating section 101 are set to be not in contact, and so the capacitors for the resonance, RC1, is not connected to the antenna line A.

Furthermore, the configuration that the antenna line A with 3 turns (A3) switches to 1 turn (A1) and 2 turns (A2) was described, but this is just one example; therefore, the antenna line A with n turns may switch to n−m turns and m turns. (n is an integer of more than 2 and m is an integer of more than 1. n>m).

Moreover, a configuration for adjustment, switching the number of turns of the RFID antenna section 41, configured as described above, is described.

Figure 5:
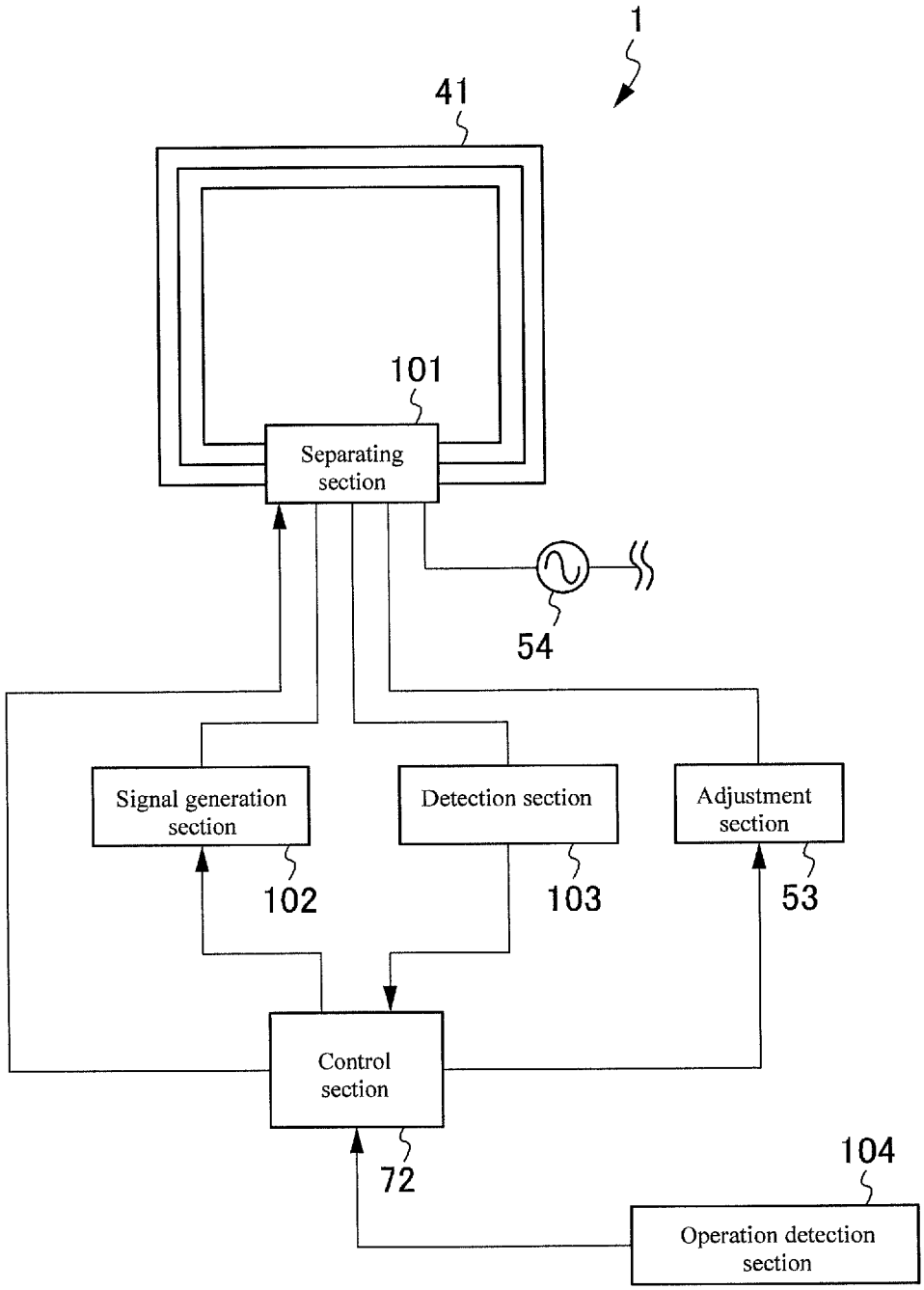
FIG. 5 is a functional block diagram of the periphery of an RFID antenna section.

As shown in FIG. 5, the mobile phone device 1 comprises a separating section 101, a signal generation section 102 and a detecting section 103.

The separating section 101 separates the RFID antenna section 41 into a first loop section that rotates a first number of rotations (e.g. 2 turns) that is less than a predetermined number of rotations (e.g. 3 turns) and a second loop section that rotates a second number of rotations (e.g. 1 turn) that is derived from subtraction of the first number of rotations (e.g. 1 turn) from a predetermined number of rotations. Moreover, the separating section 101 is connected to the power feeding section 54.

The signal generation section 102 is connected to either the first loop section or the second loop section and a signal at the reference frequency is generated from the side of the relevant connected loop section.

The detecting section 103 is connected to the other one of the first loop section and the second loop section, and detects the electrical characteristics of the relevant connected loop section. That is, the detecting section 103 is connected to a different loop section from where the loop section in which the signal generation section 102 is connected.

When configured in this way, the adjustment section 53 is connected to the other one of the first loop section and the second loop section, and adjusts the resonance frequency of the relevant connected loop section. For example, when the signal generation section 102 is connected to the first loop section, the detecting section 103 and the adjustment section 53 are connected to the second loop section.

Moreover, the control section 57 separates the RFID antenna section 41 into the first loop section and the second loop section by the separating section 101, generates the signal of the reference frequency from either the first loop section or the second loop section by the signal generation section 102, detects the electrical characteristics of the other one of the first loop section and the second loop section and furthermore adjusts the resonance frequency of other one of the first loop section and the second loop section by the adjustment section 53 according to the detection result of the detecting section 103.

Herein, the process for adjusting the resonance frequency is described in detail. The separating section 101 separates the RFID antenna section 41 into the first loop section and the second loop section according to the control of control section 57.

The control section 57 connects the first loop section to the signal generation section 102 and contacts the second loop section to the detecting section 103 and the adjustment section 53.

The signal generation section 102 generates a reference signal according to the control of the control section 57. The first loop section radiates the radio wave at the prescribed frequency externally based on the reference signal generated from the signal generation section 102.

Then, the second loop section receives the radio wave generated from the first loop section. The detecting section 103 detects the voltage value based on the radio wave received from the second loop section.

The adjustment section 53 adjusts the resonance frequency according to the control of the control section 57 such that the voltage value detected by the detecting section 103 reaches the maximum.

Furthermore, the configuration that the first loop section is connected to the signal generation section 102, and the second loop section is connected to the detecting section 103 and the adjustment section 53 was mentioned above, but without being limited to this, the second loop section may be connected to the signal generation section 102 and the first loop section may be connected to the detecting section 103 and the adjustment section 53.

Thus, the mobile phone device 1 can preferably perform adjustment of the resonance frequency of the other loop separated by separating the RFID antenna section 41 into the first loop section and the second loop section under the prescribed conditions, radiating the radio wave of the prescribed frequency from the one loop connected to the signal generation section 102, receiving the radiated radio wave by the other loop, detecting the electrical characteristics (e.g. voltage or strength of reception, etc.) by the detecting section 103 connected to the other loop section and adjusting the resonance frequency by the adjustment section 53 such that these electrical characteristics becomes maximum.

Moreover, as shown in FIG. 5, the mobile phone device 1 preferably comprises an operation detecting section 104 to detect operations. In this case, when a prescribed operation is performed at the operation detecting section 104, the control section 57 separates the RFID antenna section 41 into the first loop section and the second loop section by the separating section 101, generates the signal of the reference frequency from either the first loop or the second loop by the signal generation section 102, detects the electrical characteristics (e.g. voltage or strength of reception, etc.) of the other one of the first loop section and the second loop section by the detecting section 103, and adjusts the resonance frequency of the other loop section of the first loop section and the second loop section by the adjustment section 53 according to the detection result of the detecting section 103.

Herein, a prescribed operation is an operation for operating the functions of the RFID processing section 51. For example, the mobile phone device 1, in normal conditions, is configured such that the function of the RFID processing section 51 is restrained for electrical power saving and security. On the other hand, the function of RFID processing section 51 may be realized by a prescribed operation from a user as a trigger for operating. Moreover, the mobile phone device 1 may let the function of the RFID processing section 51 provided serve by the prescribed external equipment is adjacently operated as a trigger.

Therefore, mobile phone device 1 separates the RFID antenna section 41, and adjusts the resonance frequency of the first loop section and the second loop section when a prescribed operation is detected by the operation detecting section 104, as a trigger, so that communication with external equipment may perform with a preferred resonance frequency.

Moreover, the control section 57 regularly separates the RFID antenna section 41 into the first loop section and the second loop section by the separating section 101, generates the signal of the reference frequency from one of the first loop section and the second loop section by the signal generation section 102, detects the electrical characteristics (e.g. a voltage or a strength of the reception, etc.) of the other one of the first loop section and the second loop section by the detecting section 103, adjusts the resonance frequency of the other one of the first loop section and the second loop section by the adjustment section 53 according to detection result of the detecting section 103.

Herein, when the mobile phone device 1 is a standby state for communication, it performs the confirmation of incoming calls and messages regularly to a base station. The control section 57 taking advantage of the regular confirmation process, separates the RFID antenna section 41 into the first loop section and the second loop section, and as mentioned above, controls the resonance frequency of the first loop section and second loop section.

Now therefore, because the mobile phone device 1 preferably adjust the resonance frequency of the first loop section and the second loop section separated the RFID antenna section 41 regularly, the communication with external equipment may be performed with a stable and preferred resonance frequency. For example, in accordance with the use of the mobile phone device 1, even if the resonance frequency of the RFID antenna section 41 has some minor deviations, the resonance frequency is suitably adjusted and communication with the external equipment is preferably maintained.

Moreover, in the mobile phone device 1, the signal generation section 102, the detecting section 103 and the adjustment section 53 are preferred to connect to both the first loop section and the second loop section.

In this case, the control section 57 separates the RFID antenna section 41 into the first loop section and the second loop section by the separating section 101, generates (radiating) the signal of the reference frequency (e.g. radio wave) from both the first loop section and the second loop section by the signal generation section 102, detects the electrical characteristics of both the first loop section and the second loop section (e.g. voltage or strength of reception, etc.) by the detecting section 103 and, subsequently, adjust the resonance frequency of both the first loop section and the second loop section by the adjustment section 53 according to the detection result of the detecting section 103.

Herein, the operation is described specifically. The first loop section is connected to the signal generation section 102 and the second loop section is connected to the detecting section 103 and the adjustment section 53, under the prescribed conditions by the control section 57 is connected. The signal generation section 102 generates the reference signal according to the control of the control section 57. The first loop section radiates the radio wave of the prescribed frequency externally based on the reference signal generated from the signal generation section 102.

The second loop section receives the radio wave generated from the first loop section. The detecting section 103 detects the voltage value based on the radio wave received from the second loop section.

The adjustment section 53 adjusts the resonance frequency according to the control of the control section 57 such that the voltage value detected by the detecting section 103 becomes the maximum.

Subsequently, the control section 57 switches to connect the second loop section to the signal generation section 102 and the first loop section to the detecting section 103 and the adjustment section 53 under the prescribed conditions. The signal generation section 102 generates the reference signal according to the control of the control section 57. The second loop radiates the radio wave of the prescribed frequency externally based on the reference signal generated from the signal generation section 102.

The first loop section receives the radio wave radiated from the second loop section. The detecting section 103 detects the voltage value based on the radio wave received from the first loop section.

The adjustment section 53 adjusts the resonance frequency according to the control of the control section 57 such that the voltage value detected by the detecting section 103 becomes the maximum.

Thus, the mobile phone device 1 separates the RFID antenna section 41 into the first loop section and the second loop section under the prescribed conditions, connects signal generation section 102 to the first loop section, connects the detecting section 103 and the adjustment section 53 to the second loop, adjusts the resonance frequency of the second loop section by the adjustment section 53, next, connects the signal generation section 102 to the second loop section, connects the detecting section 103 and the adjustment section 53 to the first loop section and adjusts resonance frequency of the first loop section by the adjustment section 53. Now therefore, the mobile phone device 1 can preferably adjust the resonance frequency of the first loop section using the second loop section and can preferably adjust the resonance frequency of the second loop section using the first loop section.

Moreover, a configuration in which the control section 57 releases the separation by the separating section 101, together with adjusting the resonance frequency of the RFID antenna section 41 in accordance with the electrical characteristics (e.g. voltage or strength of reception, etc.) of both the first loop section and the second loop section detected by the detecting section 103 by the adjustment section 53 is preferred.

Thus, the mobile phone device 1 releases the separation by separating section 101, that is, the number of turns of the RFID antenna section 41 is changed back to the predetermined number of times (e.g. 3 turns) and adjust the resonance frequency of the RFID antenna section 41 in accordance with electrical characteristics (e.g. voltage or strength of reception, etc.) of both the first loop section and the second loop section obtained in separate states. Accordingly, the electrical characteristics when the number of turns of RFID antenna section 41 are the predetermined number of times need not be measured and the resonance frequency of the RFID antenna section 41 can preferably be adjusted.

Moreover, the separating section 101 preferably separates the RFID antenna section 41 into the first loop section and the second loop section such that the first number of rotations and the second number of rotations are equal.

The mobile phone device 1, for example, when the RFID antenna section 41 has 6 rotations (6 turns) that is the predetermined number of rotations and is separated into the first loop section of the first number of rotations that is 1 rotation (1 turn) and the second loop section of the second number of rotations that is 5 rotations (5 turns) by the separating section 101 is described.

The first loop section can extend the communication distance but the receivable frequency range is tend to be narrow because Q value of the antenna becomes higher (larger) than the second loop section that has more turns. Moreover, when the communication distance is long there is a greater tendency to occur a null (the region where communication is not easy to communicate with the external equipment).

On the other hand, the second loop section can receive signals in the wide frequency range but the communication distance is tended to be short because Q value of the antenna becomes lower (smaller) than the first loop section.

There, the mobile phone device 1 separates the RFID antenna section 41 into the first loop section and the second loop section by the separating section 101 such that the first number of rotations and the second number of rotations are equal (in the embodiment, both the first number of rotations and the second number of rotations are 3 rotations (3 turns)). Now therefore, the mobile phone device 1 set the Q values of the antennas of the first loop section and the second loop section to average and can communicate at a prescribed communication distance.

Moreover, the mobile phone device 1 can communicate with external equipment with preferred resonance frequency because the resonance frequency of the first loop section and the second loop section separated by the separating section 101 are adjusted.

The adjustment section 53, as above mentioned, is a variable capacitor (a circuit for adjusting the resonance frequency, RC4) connected to the RFID antenna section 41. The control section 57 adjusts the resonance frequency of the RFID antenna section 41 by adjusting the capacity of the adjustment section 53 such that a high-order resonance frequency of the RFID antenna section 41 is spaced apart from the useful frequency band of the main antenna section 62.

As configured in this way, in the mobile phone device 1, it becomes possible not to overlap a high-order secondary resonance point of the useful frequency band (the first useful frequency band) of the RFID antenna section 41 with the useful frequency band (the second useful frequency band) of the main antenna section 62. Accordingly even if the multiple antenna having different frequency bands are aligned adjacent one another, the communications quality can be maintained because the gain degradation of the antenna decreases.

Moreover, when the useful frequency band of the RFID antenna section 41 set as factory default value is changed within a prescribed definite range, first, the mobile phone device 1 adjusts the resonance frequency of the RFID antenna section 41 to the value set at first, subsequently, a high-order secondary resonance point may be adjusted not to overlap with the useful frequency band of the main antenna section 62.

<Method for the Adjustment of Resonance Frequency in Detail>

Figure 6:
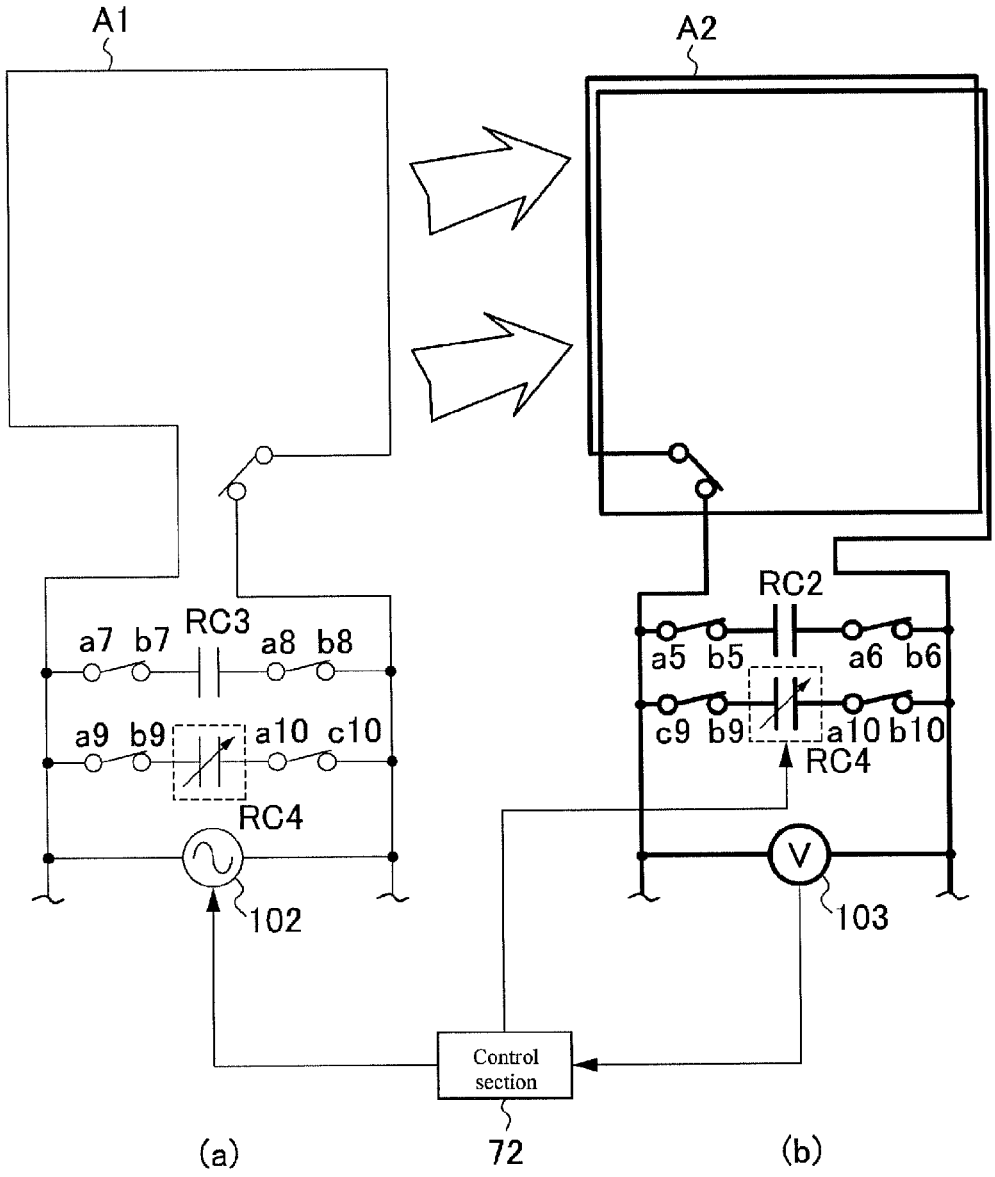
FIG. 6 is a first figure provided to describe the operation when the resonance frequency of an antenna is adjusted.

Next, the RFID antenna section 41 is separated into antennas in which the antenna line A configured with 1 turn (A1) (refer to FIG. 6(*a*)) and with 2 turns (A2) (refer to FIG. 6(*b*)) by the separating section 101 and the specific operation when the resonance frequency of the other antenna is adjusted by the other antenna is described.

Herein, the resonance frequency f0 of the antenna is expressed in the following formula.

$$f0=\frac{1}{2\pi}(\sqrt{(LC)}) \quad (1)$$

L is a inductance value of the antenna line A. C is a combined capacity of the capacitor for the resonance RC1,RC2 and RC3 and the circuit for adjusting the resonance frequency, RC4 (a capacitor) connected to the antenna line A.

First, the operation when the resonance frequency of the antenna configured with 2 turns (A2) is adjusted by the antenna configured with 1 turn (A1) is described.

As shown in FIG. 6 (*a*), the signal generation section 102 generating the reference signal, the capacitor for the resonance, RC3, and the circuit for adjusting the resonance frequency, RC4 is connected to a side of the antenna configured with 1 turn (A1). Moreover, as shown in FIG. 6 (*b*), the detecting section 103, capacitor for the resonance, RC2, and the circuit for adjusting the resonance frequency, RC4 is connected to a side of the antenna configured with 2 turns (A2). Furthermore, in the present example, the circuit for adjusting the resonance frequency, RC4 is shared by the side of antenna configured with 1 turn (A1) and the side of antenna configured with 2 turns (A2) by switching appropriately, but the side of antenna configured with 1 turn (A1) and the side of antenna configured with 2 turns (A2) may comprise the very owned circuit for adjusting the resonance frequency respectively.

The signal generation section 102 generates the reference signal according to the control of the control section 57. The antenna configured with 1 turn (A1) radiates the radio wave of the prescribed frequency (e.g. 13.56 MHz) externally based on the reference signal generated by the signal generation section 102.

And, the antenna configured with 2 turns (A2) receives the radio wave radiated from the antenna with 1 turn (A1). The detecting section 103 detects the voltage value based on the radio wave received from the antenna configured with 2 turns (A2).

The control section 57 varies the capacity value of the circuit for adjusting the resonance frequency, RC4, connected to the side of antenna configured with 2 turns (A2) such that the voltage value detected by the detecting section 103 becomes maximum. Moreover, the control section 57 calculates the L2 value of the antenna configured with 2 turns (A2) from the (2) formula based on the capacity value of the circuit for adjusting the resonance frequency, RC4 in which the voltage value detected by the detecting section 103 becomes maximum.

$$L2=\frac{1}{4\pi 2f02C} \quad (2)$$

C is a combined capacity value of the capacitor for the resonance, RC2, connected to the side of antenna configured with 2 turns (A2) and the circuit for adjusting the resonance frequency, RC4.

Next, an operation when the resonance frequency of the antenna configured with 1 turn (A1) is adjusted by the antenna configured with 2 turns (A2) is described.

Figure 7:
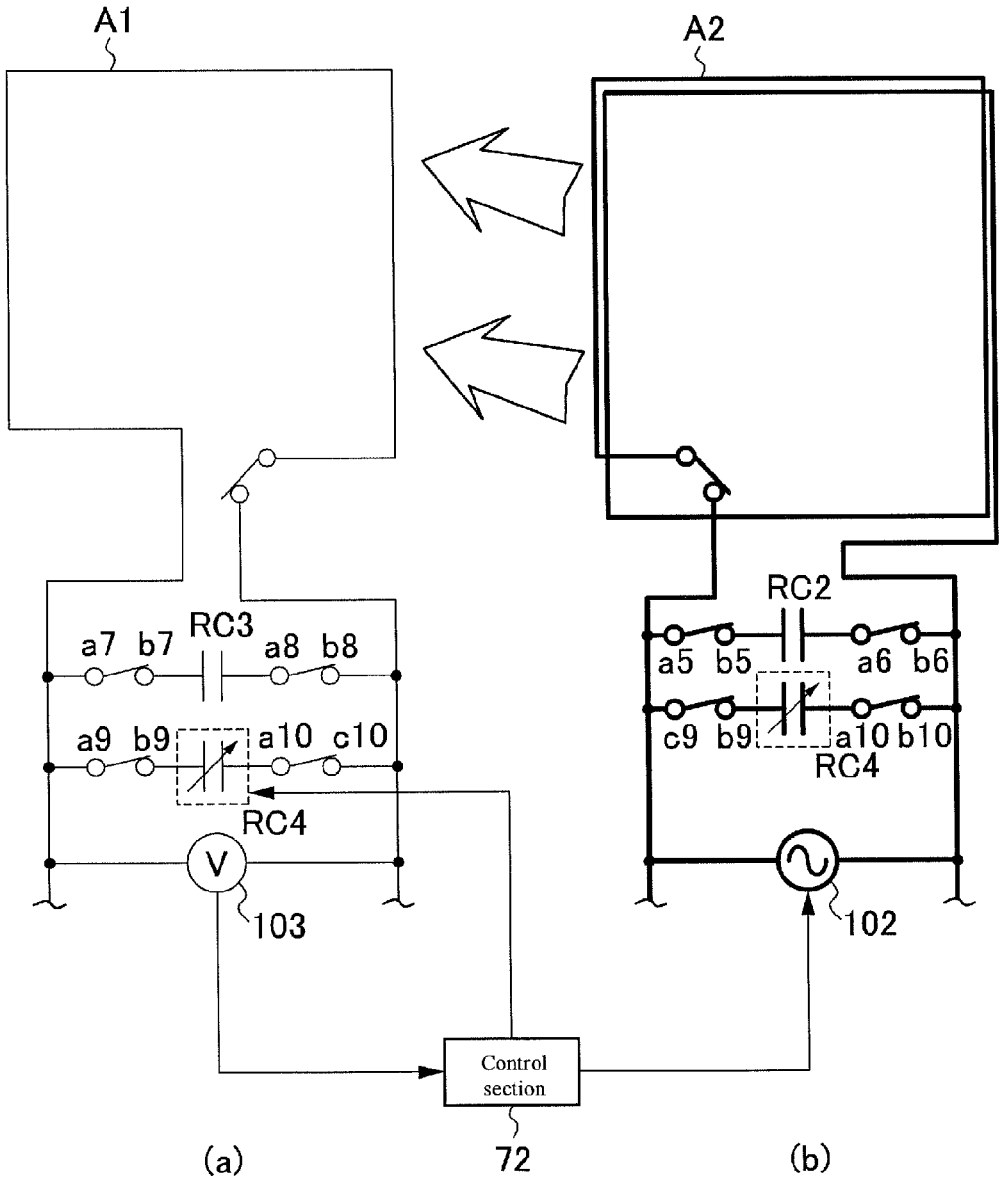
FIG. 7 is a second figure provided to describe the operation when the resonance frequency of an antenna is adjusted.

As shown in FIG. 7(*a*), the detecting section 103, a capacitor for the resonance, RC3, and the circuit for adjusting the resonance frequency, RC4 is connected to the side of the antenna configured with 1 turn (A1). Moreover, as shown in FIG. 7(*b*), the signal generation section 102 generating the reference signal, the capacitor for the resonance RC2 and the circuit for adjusting the resonance frequency, RC4 is connected to the side of the antenna configured with 2 turn (A2). Moreover, in the present example, the circuit for adjusting the resonance frequency, RC4 is shared by the side of antenna configured with 1 turn (A1) and the side of antenna configured with 2 turns (A2) by switching appropriately, but the side of antenna configured with 1 turn (A1) and the side of antenna configured with 2 turns (A2) may comprise the very owned circuit for adjusting the resonance frequency respectively.

The signal generation section 102 generates the reference signal according to the control of the control section 57. The antenna configured with 2 turns (A2) radiates the radio wave of the prescribed frequency (e.g. 13.56 MHz) externally based on the reference signal generated from the signal generation section 102.

And, the antenna configured with 1 turn (A1) receives the radio wave generated from the antenna configured with 2 turns (A2). The detecting section 103 detects the voltage value based on the radio wave received from the antenna configured with 1 turn (A1).

The control section 57 varies the capacity value of the circuit for adjusting the resonance frequency, RC4, connected to the side of antenna configured with 1 turns (A1) such that the voltage value detected by the detecting section 103 becomes maximum. Moreover, the control section 57 calculates the L1 value of the antenna configured with 1 turns (A1) from the (3) formula based on the capacity value of the circuit for adjusting the resonance frequency, RC4 in which the voltage value detected by the detecting section 103 becomes maximum.

$$L1=\frac{1}{4\pi 2f02C} \quad (3)$$

C is a combined capacity value of the capacitor for the resonance, RC3, connected to the side of antenna configured with 1 turns (A1) and the circuit for adjusting the resonance frequency, RC4.

Moreover, when the antenna configured with 3 turns, control section 57 adjusts the resonance frequency of the antenna configured with 3 turns by calculating L combined L2 calculating by (2) formula with L1 calculating by (3) formula.

$$L=L2+L1 \quad (4)$$

Moreover, the control section 57 calculates by varying the capacity of the capacitor for the resonance and the combined capacity value of the capacity of circuit for adjusting the resonance frequency, RC4, when the antenna configured with 3 turns and the capacity of the circuit for adjusting the resonance frequency, RC4 such that the resonance frequency f0 becomes the prescribed frequency (e.g. 13.56 MHz) by (1) and (4) formulas.

Thus, the mobile phone device 1 can adjust the antenna configured with 1 turn (A1), the antenna configured with 2 turns (A2) and the antenna configured with 3 turns respectively.

<A Method for Decreasing the Effect of a High-Order Resonance Frequency>

Next, a method for decreasing the effect of a high-order resonance frequency of the RFID antenna section 41 on the main antenna section 62 is described.

Moreover, in the present example, in the RFID antenna section 41, copper lines having a prescribed diameter are wrapped in a multiple spiral form for about 3 rotations (turns) to form a loop of a prescribed size. Moreover, in the present example, the number of turns of the RFID antenna section 41 is described as 3 turns, but not limited to this, it may be 2 turns, 4 turns or other number of turns.

When the communication of CDMA using the main antenna section 62 is performed, one of the band frequency with CDMA has following frequency band.

Received frequency band: 843 to 846 MHz, 860 to 870 MHz

Transmit frequency band: 898 to 901 MHz, 915 to 925 MHz

The communication with CDMA method performs communication by the FDD method (Frequency Division Duplex method), for example, when receiving with 843 MHz, sends with 898 MHz at the same time. Therefore, for a high-order resonance frequency of the RFID antenna section 41 not to overlap the communication frequency of the CDMA, that is, for reducing the effect by the high-order resonance frequency of the RFID antenna section 41, the resonance frequency of the RFID antenna section 41 needed to be set to avoid the frequency of both 843 MHz and 898 MHz.

Herein, when the RFID antenna section 41 is used in 3 turns, L value of the antenna is calculated as 3 μH by the (4) formula and the resonance frequency is set to be 13.548 MHz, the capacity of capacitor for the for the resonance (combined capacity of capacitor for the for the resonance RC1, RC2 with RC3 and the circuit for adjusting the resonance frequency, RC4) is about 46 pF by (1) formula.

In this case, a high-order resonance frequency, 60 degrees to 69 degrees, of the RFID antenna section 41 is generated at a prescribed frequency as shown in FIG. 8.

As shown in FIG. 8, the frequency of 64 degree and 68 degree are overlapped to the received frequency band "860 to 870 MHz" and the transmit frequency band "915 to 925 MHz" used in CDMA as mentioned above respectively. Therefore, when the mobile phone device 1 performs the communication with received frequency band "860 to 870 MHz" and the transmit frequency band "915 to 925 MHz" using the antenna section 62, the mobile phone device 1 changes the capacity of the capacitor for the resonance.

Moreover, when the capacity of the capacitor for the resonance is changed, making the capacity value as small as possible allows the resonance frequency of RFID antenna section 41 to be increased and a high-order resonance frequency to be wider, so that it is useful to avoid effects on sending and receiving by the main antenna section 62.

The capacitor for the resonance RC1,RC2 and RC3 and the circuit for adjusting the resonance frequency, RC4 of the mobile phone device 1 are enable to be switched by the separating section 101. Accordingly, when the capacitor for the resonance is set to be smallest capacity as possible (e.g. 1 pF). the capacity of the capacitor for the resonance can be reduced to the capacity, For example, when the capacity of the capacitor for the resonance is set to be 1.5 pF, the resonance frequency of the RFID antenna section 41 is 75.026 MHz. A high-order resonance frequency, 5 degree to 14 degree, of the RFID antenna section 41 is a frequency shown in FIG. 9.

Accordingly, when the communication with the received frequency band "860 to 870 MHz" and the transmit frequency band "915 to 925 MHz" using the main antenna section 62 is performed, the effect on the RFID antenna section 41 is reduced.

Moreover, as shown in FIG. 9, when the communication with the received frequency band "843 to 846 MHz" and the transmit frequency band "898 to 901 MHz" using the main antenna section 62 is performed, setting the capacity of the capacitor for the resonance as 1 pF enables to reduce the effect caused by the frequency of 12 degree of the RFID antenna section 41 on the RFID antenna section 41, because the frequency of 12 degree of the RFID antenna section 41 is overlap the received frequency band "843 to 846 MHz" and the transmit frequency band "898 to 901 (refer to FIG. 10).

In this way, the mobile phone device 1 changes the capacity of the capacitor for the resonance of the RFID antenna section 41 according to the frequency band communicating by the main antenna section 62. Accordingly, the effect of a high-order resonance frequency of the RFID antenna section 41 to the main antenna section 62 is reduced.

Moreover, the mobile phone device 1 performs the change (adjustment) the resonance frequency of the RFID antenna section 41 in accordance with the frequency band in which the communication in the main antenna section 62 is performed, when the communication is performed without the main antenna section 62, the resonance frequency of the RFID antenna section 41 may be not changed (adjusted) and may be adjusted to the RFID resonance frequency. Therefore, the mobile phone device 1 is in the state in which the function of RFID is available to use.

Figure 11:
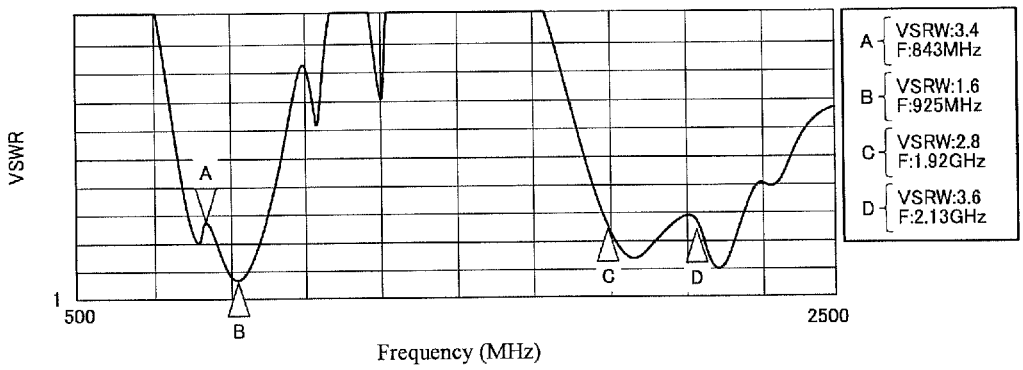
FIG. 11 is a figure showing the result of a measurement of VSWR after the resonance frequency of the RFID antenna section is adjusted.
Figure 12:
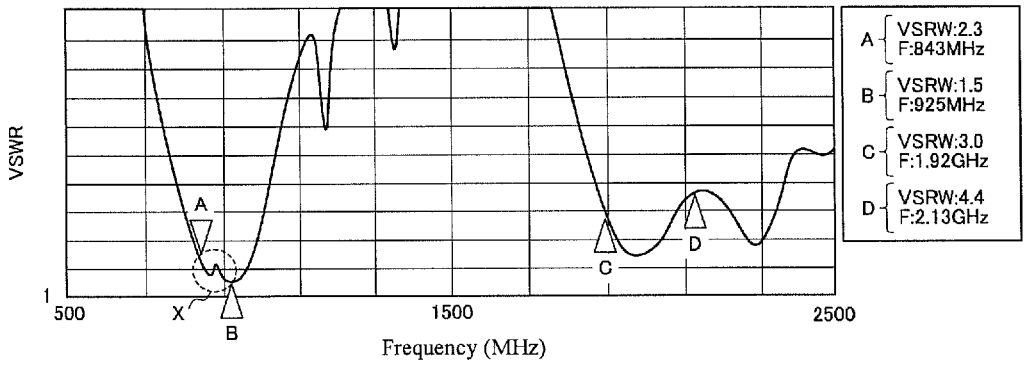
FIG. 12 is a figure showing the result of a measurement of VSWR before a resonance frequency of the RFID antenna section is adjusted.

Moreover, FIG. 11 shows the result of VSWR (Voltage Standing Wave Ratio) measured with frequency of 500 MHz to 2.5 GHz by the method of the present invention after adjusting the resonance frequency of the RFID antenna section 41 by the example of the present invention. FIG. 12 shows the result of VSWR measured with frequency of 500 MHz to 2.5 GHz before adjusting the resonance frequency of the RFID antenna section 41. The measurement was done by setting the measurement device (network analyzer) connected to the power feeding point of the main antenna section 62 of the mobile phone device 1. The measurement was done using the mobile phone device in which the bandwidth of the useful frequency band covers the received frequency band and the transmit frequency band used in CDMA. Thus, the mobile phone device receives and sends the signal having the frequency 843 MHz to 925 MHz (A point to B point in FIG. 11 and FIG. 12) and 1.92 GHz to 2.18 GHz (C point to D point in FIG. 11 and FIG. 12).

As is clear in FIG. 11 and FIG. 12, however, the effects of a high-order resonance point of the RFID antenna section 41 (X in FIG. 12) are generated at 843 MHz to 925 MHz (A point to B point in FIG. 12) before adjusting the resonance frequency of the RFID antenna section 41 (FIG. 12), the effects of a high-order resonance point of the RFID antenna section 41 are reduced at 843 MHz to 925 MHz (A point to B point in FIG. 11) after adjusting the resonance frequency of the RFID antenna section 41 (FIG. 11).

Therefore, the mobile phone device 1 adjusts the resonance frequency by changing L value of the RFID antenna section 41 by the method of the present invention, changes L value of the RFID antenna section 41 after the relevant adjustment. Therefore, a high-order resonance point of the RFID antenna section 41 can be displaced from the frequency band used by the main antenna section 62. Accordingly, if there is a dispersion in the resonance frequency f0 of the RFID antenna section 41 due to an aging change or a drop, etc., the effect on the main antenna section 62 may be decreased and the gain degradation of the main antenna section 62 may be decreased.

Moreover, because the mobile phone device 1, as described above, can adjust the resonance frequency f0 of the RFID antenna section 41 of the RFID antenna section 41, even if there is a dispersion of the resonance frequency f0 of the RFID antenna section 41 due to an aging change or a drop, etc., and the sensitivity is degraded, the resonance frequency f0 of the RFID antenna section 41 can be adjusted to the frequency that is set in the factory and a good sensitivity can be maintained.

Moreover, the mobile phone device 1 preferably perform the adjustment within a prescribed range of the specification (within the range in which communication by the RFID antenna section 41 is possible) when adjusting the resonance frequency of the RFID antenna section 41 by the adjustment section 53.

Moreover, in the present example, the resonance frequency of the RFID antenna section 41 is described as being adjusted by switching the number of turns of the RFID antenna section 41, but it is not limited to this. For example, the mobile phone device 1 may comprise a reference frequency radiant section that radiates the reference frequency (e.g. 13.56 MHz), receives the signal radiated from the relevant reference frequency radiant section by the RFID antenna section 41 and adjusts the resonance frequency of the RFID antenna section 41 by the adjustment section 53 such that the receiving sensitivity becomes optimal.

While at least one exemplary embodiment is presented in the foregoing detailed description, the present disclosure is not limited to the above-described embodiment or embodiments. Variations may be apparent to those skilled in the art. In carrying out the present disclosure, various modifications, combinations, sub-combinations and alterations may occur in regard to the elements of the above-described embodiment insofar as they are within the technical scope of the present disclosure or the equivalents thereof. The exemplary embodiment or exemplary embodiments are examples, and are not intended to limit the scope, applicability, or configuration of the disclosure in any way. Rather, the foregoing detailed description will provide those skilled in the art with a template for implementing the exemplary embodiment or exemplary embodiments. It should be understood that various changes can be made in the function and arrangement of elements without departing from the scope of the disclosure as set forth in the appended claims and the legal equivalents thereof. Furthermore, although embodiments of the present disclosure have been described with reference to the accompanying drawings, it is to be noted that changes and modifications may be apparent to those skilled in the art. Such changes and modifications are to be understood as being comprised within the scope of the present disclosure as defined by the claims.

Terms and phrases used in this document, and variations hereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the present disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

What is claimed is:

1. A mobile electronic device comprising:

a housing;

a first antenna section that is arranged in the housing, and sends and receives signals on a first useful frequency band;

a second antenna section that is arranged in the housing, and sends and receives signals on a second useful frequency band that is a higher frequency band than the first useful frequency band;

an adjustment section that adjusts a resonance frequency of the first antenna section; and a control section that identifies a reactance value of the first antenna section based on a receiving sensitivity with respect to the signals on the first useful frequency band, and adjusts, by the adjustment section, the resonance frequency of the first antenna section based on the identified reactance value such that a high-order resonance frequency of the first antenna section is spaced apart from the second useful frequency band in cases in which the receiving sensitivity falls below a predetermined value when the second antenna section receives a signal on the second useful frequency band.

2. The mobile electronic device according to claim 1, comprising:

a separating section that separates the first antenna section into a first loop section that turns a first number of rotations that is less than a predetermined number of rotations and a second loop section that turns a second number of rotations, which is a number of rotations derived from the subtraction of the first number of rotations from the predetermined number of rotations;

a signal generation section that is connected to either the first loop section or the second loop section and generates a signal at a reference frequency from a loop section of a relevant connected side;

a detecting section that is connected to the other one of the first loop section and the second loop section and detects electrical characteristics of the relevant connected loop section;

wherein, the adjustment section is connected to the other one of the first loop section and the second loop section and adjusts the resonance frequency of the relevant connected loop section, the control section separates the first antenna section into the first loop section and the second loop section by the separating section, generates a signal at a reference frequency of one of the first loop section and the second loop section by the signal generation section and detects an electrical characteristics of the other one of the first loop section and the second loop section by the detecting section, and adjusts a resonance frequency of the other one of the first loop section and the second loop section by the adjustment section in accordance with detection result of the detecting section.

3. The mobile electronic device according to claim 2, further comprising an operation detecting section that detects operations, wherein, the control section separates the first antenna section into the first loop section and the second loop section when a prescribed operation is detected, generates a signal of reference frequency from one of the first loop section and the second loop section by the signal generation section, and detects electrical characteristics of the other one of the first loop section and the second loop section by the detecting section, and adjusts the resonance frequency of the other one of the first loop section and second loop section by the adjustment section in accordance with the detection result of the detecting section.

4. The mobile electronic device according to claim 2, wherein the control section periodically separates the first antenna section into the first loop section and the second loop section, generates a signal at a reference frequency from one of the first loop section and the second loop section by the signal generation section, detects electrical characteristics of the other one of the first loop section and the second loop section by the detecting section, and adjusts the resonance frequency of the other one of the first loop section and second loop section by the adjustment section in accordance with the detection result of the detecting section.

5. The mobile electronic device according to claim 2, wherein the signal generation section, the detecting section and the adjustment section are connectable to both the first loop section and the second loop section, the control section separates the first antenna section into the first loop section and the second loop section by the separating section, generates a signal at a reference frequency from both the first loop section and the second loop section by the signal generation section, and detects both electrical characteristics of the first loop section and the second loop section by the detecting section, and adjusts the resonance frequencies of both the first loop section and second loop section by the adjustment section in accordance with the detection results of the detecting section.

6. The mobile electronic device according to claim 5, wherein the control section releases the separation by the separating section, and adjusts the resonance frequency of the first antenna section by the adjustment section in accordance with electrical characteristics of both the first loop section and the second loop section detected by the detecting section.

7. The mobile electronic device according to claim 2, wherein the separating section separates into the first loop section and the second loop section such that the first number of rotations and the second number of rotations are equal.

8. The mobile electronic device according to claim 1, further comprising a variable type capacitor connected to the first antenna section, wherein the control section adjusts the resonance frequency of the first antenna section by adjusting the capacitance of the capacitor by the adjustment section such that a high-order resonance frequency of the first antenna section is spaced apart from the second useful frequency band.

* * * * *